United States Patent [19]

Petersen et al.

[11] 4,314,365

[45] Feb. 2, 1982

[54] ACOUSTIC TRANSMITTER AND METHOD TO PRODUCE ESSENTIALLY LONGITUDINAL, ACOUSTIC WAVES

[75] Inventors: Clifford W. Petersen, Missouri City; John M. Bednar, Houston; Edwin J. Hocker, Jr., Houston, all of Tex.; David H. Gauger, Mesa; James M. Henderson, Scottsdale, both of Ariz.

[73] Assignees: Exxon Production Research Company, Houston, Tex.; Motorola, Inc., Phoenix, Ariz.

[21] Appl. No.: 113,831

[22] Filed: Jan. 21, 1980

[51] Int. Cl.[3] ..... G01V 1/40; E21B 43/00

[52] U.S. Cl. ..... 367/82; 175/56

[58] Field of Search ..... 367/81, 82; 175/40, 175/50, 56; 73/152

[56] References Cited

U.S. PATENT DOCUMENTS

| | | | |
|---|---|---|---|
| 3,016,093 | 1/1962 | Bodine | 175/56 |
| 3,155,163 | 11/1964 | Bodine | 175/56 |
| 3,168,140 | 2/1965 | Bodine | 175/56 |
| 3,193,027 | 7/1965 | Bodine | 175/56 |
| 3,252,225 | 5/1966 | Hixson | 367/82 |
| 3,402,611 | 9/1968 | Schwenzfeier | 175/56 |
| 3,564,932 | 2/1971 | Lebelle | 175/56 |
| 3,980,986 | 9/1976 | Baird et al. | 367/82 |
| 4,001,773 | 1/1977 | Lamel et al. | 367/82 |
| 4,038,632 | 7/1977 | Parker | 367/82 |
| 4,073,341 | 2/1978 | Parker | 367/82 |

OTHER PUBLICATIONS

McDonald et al., "Borehole Telemetry . . . Measurements", 9/15/75, pp. 111-118, The Oil & Gas Journal.

Lord et al., "Attenuation of Elastic . . . Detection", 11/77, pp. 49-54, Materials Evaluation, vol. 35, #11.

Squire et al., "A New Approach to Drill-String . . . Telemetry", 9/1979, pp. 1-8, 54th Annual Soc. of Petro. Eng. of AIME Conference.

Barnes et al., "Passbands for Acoustic Transmission . . . ", 11/71, pp. 1606-1608, Journal of Acoust. Soc. of America, vol. 51, #5.

*Primary Examiner*—Nelson Moskowitz

*Attorney, Agent, or Firm*—Robert B. Martin

[57] ABSTRACT

A portable, electrohydraulic, acoustic transmitter releasably attaches to a solid medium such as a drill string to generate essentially longitudinal, acoustic signals in the medium. The signals are frequency modulated so that encoded messages may be transmitted between a surface and subsurface location to activate downhole equipment.

2 Claims, 7 Drawing Figures

ACOUSTIC TRANSMITTER AND METHOD TO PRODUCE ESSENTIALLY LONGITUDINAL, ACOUSTIC WAVES

BACKGROUND OF THE INVENTION

1. Field of the Invention

This invention relates to acoustic signal transmission through solids, especially through metal pipe such as a drill string. More particularly, it relates to an electrohydraulic transmitter releasably attachable to a drill string at the surface to send selected, coded frequencies of longitudinal, acoustic waves downward through the drill string to a subsurface receiver.

2. The Prior Art

Telemetry is a major research area for rotary drilling operations. A reliable system to communicate to or from a subsurface equipment package is coveted by most individuals involved in the art. Numerous solutions for transmitting information have been studied. One approach employs a physical communication line to transmit signals by mechanical, hydraulic, pneumatic, or electrical pulses. Use of these systems is costly in terms of the outlay for materials and of the installation and operational costs.

Others have tried to avoid the problems of communication lines within the drill string. In U.S. Pat. No. 3,737,845 (Maroney et al.), electrical signals are transmitted from the surface to a subsurface receiver through the strata surrounding the wellbore. In U.S. Pat. No. 4,078,620 (Westlake et al.), binary coded pressure pulses are transmitted from a subsurface equipment package to the surface in the drilling mud. The pulses are created by venting drilling mud through a valve in the drill string stem. Acoustic telemetry has also been studied. At least three approaches are used. Acoustic pressure waves may travel between surface and subsurface locations in the strata surrounding the wellbore. See, e.g., U.S. Pat. No. 3,876,016. The acoustic waves may travel through the drilling mud. Signals in the mud are usually produced by a downhole turbine generator. See, e.g., U.S. Pat. Nos. 3,233,674; 4,100,528; or 4,103,281. The acoustic waves may travel through the drill string tubulars. Because this invention relates to signal transmission in the drill string, this third method will be discussed in greater detail.

In U.S. Pat. No. 3,103,643 Kalbfell discloses a downhole, electromechanical transmitter which produces acoustic waves of low frequency by vibrating adjoining pipe sections. Similarly, in U.S. Pat. No. 3,252,225 Hixson discloses a compression-wave mechanical generating system which produces low frequency, longitudinal acoustic waves by the contact of an oscillating mass with the inside of the drill string. Hixson's apparatus uses a spring and weight principle to control the frequency of the longitudinal (compressional) waves generated. The spring and weight store a burst of energy which is released whenever drilling mud circulation stops.

A somewhat different concept is revealed in U.S. Pat. No. 3,889,228. Shawhan discloses use of a series of acoustic repeaters, preferably piezoelectric accelerometers, to signal to and from a downhole equipment sub with acoustic waves of approximately 1000 Hertz (Hz). Because the signals attenuate over the relatively large distances that the acoustic waves must travel, amplification is required. Repeaters allow for transmission over greater lengths. Nevertheless, they substantially increase equipment costs; they increase handling costs; and they reduce reliability of the system.

Repeaters may be eliminated if suitable frequencies are used. Hixson discusses the advantages of low frequencies, particularly those at which the typical pipe length equals an odd number of one-quarter wavelengths. Barnes and Kirkwood use a more sophisticated model of a drill string in theorizing its two lowest passbands between 0 and 280 Herts (Hz) and between 330 and 570 Hz for optimal transmission of longitudinal acoustic waves. Barnes and Kirkwood, *Passbands for Acoustic Transmission in an Idealized Drill String,* 51 J. Acoustical Soc'y Am. 1606 (1972). To produce lower frequencies requires powerful transmitters. Power requirements limit the feasible frequencies attainable by downhole devices. Repeates may be necessary with any downhole signalling scheme, because the necessary power is unavailable. Consequently, the repeaters Shawhan discloses operate at intermediate frequencies.

Torsional waves are also discussed as suitable candidates for information transmission. In U.S. Pat. No. 3,588,804, Fort discloses a downhole, ultrasonic transducer for production of waves. Two United States patents to Lamel et al. discuss use of torsional acoustic waves of zero order as the preferred means of signalling to and from a subsurface equipment package. One, U.S. Pat. No. 3,900,827, discloses a crossed-field magnetostrictive transducer suitable for torsional wave generation. The other, U.S. Pat. No. 4,001,773, discloses an improved acoustic communication method utilizing modulated, torsional acoustic waves inherently produced as noise in the drill string by virtue of the drilling operations.

To signal from a surface location to a disaster valve positioned at the bottom end of tubing, Parker discloses three (3) transmitters in U.S. Pat. No. 4,038,632. The tubing is suspended from either a magnetostrictive or a hydraulic ram in two of the transmitter embodiments. Since the lower end of the tubing extends down into the earth, and the upper end of the tubing hangs upon rods in an unrestrained manner, the intermediate tubing is free to move or to stretch. The third transmitter is a tuned acoustic hammer which pounds periodically on the tubing. All of these systems are large, permanent additions to well completions. According to Parker, the pulses of sonic energy resolve into compression and transverse wavefronts which propagate through the pipe at differing velocities. Sensitive to this characteristic time delay in passage of the compression and transverse waves, receivers maintain the disaster valve open until reception of the signal ceases.

Many methods have been investigated. None is a commercially feasible or commercially successful apparatus for acoustic telemetry in rotary drilling operations. Downhole transmitters generate intermediate frequency acoustic waves which are attenuated during transmission in the drill string to a greater extent than low frequency waves. Larger downhole transmitters disclosed to date require substantial modification of the drilling equipment and have not proven to be successful commercially. Transmitting modulated torsional waves has not materialized as a viable alternative, nor has suspending the pipe on rams or permanently affixing a hammer to the pipe. Thus, the search continues for a commercially valuable, low frequency, longitudinal acoustic wave transmitter useful for telemetry operations in rotary drilling.

SUMMARY OF THE INVENTION

This invention discloses an electrohydraulic, acoustic transmitter which is quickly attachable to and detachable from a drill string. It is useful for sending frequency shift keyed codes through a drill string by means of low frequency, longitudinal, acoustic waves. Preferably, the transmitter is used during a stoppage of rotary drilling operations to transmit over approximately 10,000 feet or less of drill string. The transmitter of this invention is readily useable with existing equipment for rotary drilling. It fastens quickly around the drill string. It is readily detachable. It is portable. It may be used in emergency situations, drawing power from accumulators or other hydraulic supplies on the drilling rig. Thus, it solves many of the problems which limited widespread adoption of other acoustic transmitters for drilling operations.

One embodiment of this invention comprises a portable and detachable, hinged housing fastened securely around the outer periphery of a drill string tubular to contact the drill string with gripping members which are connected to the housing and to hydraulic pistons mounted on the housing. Preferably, two hydraulic pistons are (1) disposed substantially diametrically opposite one another, (2) mounted to the gripping members and to reaction masses that oscillate in a direction substantially parallel to the longitudinal axis of the drill string when the pistons move in their cylinders, and (3) controlled by electromechanical servovalves so that selected frequencies are generated. The reciprocating motion of the pistons moves reaction masses upwardly and downwardly to produce essentially longitudinal, acoutic waves within the drill string. The preferred frequencies for transmission are substantially between about 290 Hz and 400 Hz. The transmitter of this invention produces waves in this passband with practical energy requirements. The transmitter remains portable and detachable when it produces signals in this range.

Thus, the transmitter of this invention features several advantages. It may be used without modification of existing rotary drilling equipment. It is portable. It is easily operable and manageable. It can produce low frequency, longitudinal waves which transmit well along the drill string without substantial attenuation. It is a compact and efficient package which satisfies the desires of a longstanding search.

DETAILED DESCRIPTION OF A PREFERRED EMBODIMENT

Figure 1:
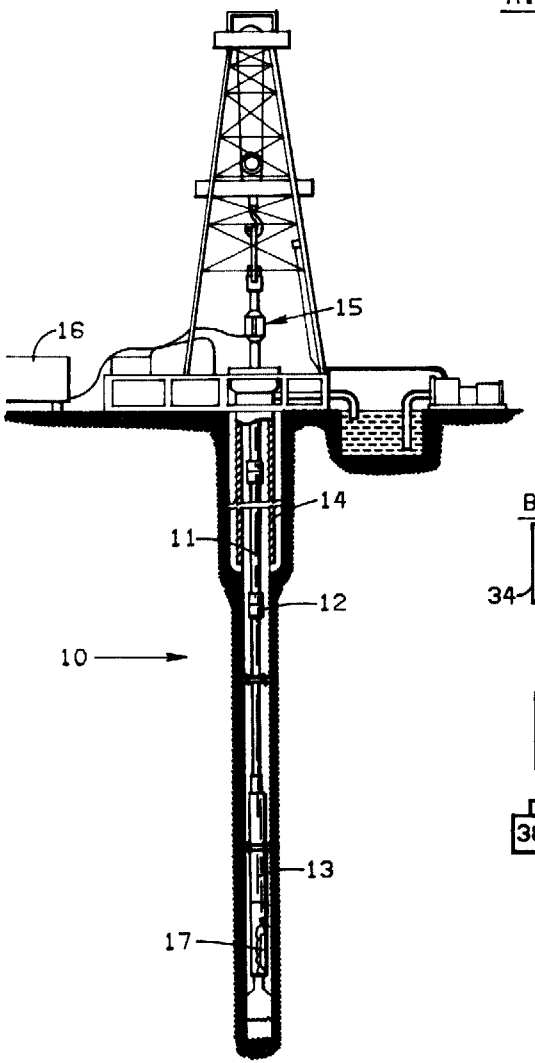
FIG. 1 is a schematic representation of the electrohydraulic, acoustic transmitter of this invention for use in rotary drilling operations.

In FIG. 1, a drill string 10 is schematically represented. The drill string 10 comprises a bottom hole assembly comprising drill-collars 13 and a pipe string consisting of drill pipe 11 with tool joints 12. Casing 14 may be cemented along a portion of the well. The acoustic transmitter 15 of this invention releasably attaches around the drill string 10 at a point at or above the surface. When actuated by suitable power means 16, the transmitter 15 sends acoustic signals downward through the drill string 10 to a downhole receiver 17. The transmitter 15 may send coded information through the drill string 10, so more than one downhole receiver 17 is possible. Each receiver 17 may be keyed to a different actuation code. When actuated, the receiver 17 activates a downhole instrument package (not shown) which performs the desired downhole function.

The power means 16, preferably, supplies both electrical and hydraulic power to the transmitter 15. Job commands are carried to the preferred electromechanical servovalves as frequency shift keyed electrical impulses. A battery or a generator may be used to power the control circuitry necessary to generate this signal. Hydraulic power is used to transform the electrical signal into an acoustic signal within the drill pipe. The power means 16 may contain a self-contained hydraulic supply. Alternatively, the source of hydraulic power may be any hydraulic supply customarily associated with equipment used in typical rotary drilling operations.

Modulation is defined as the process of transforming one form of information signal into another form. A transducer generally accomplishes the transformation. The preferred transmitter of this invention undertakes a series of five modulation steps to produce essentially longitudinal, acoustic, frequency shift keyed signals within a drill string. First, an electrical signal is generated in a voltage code. Second, the voltage code is modulated into an frequency shift shift keyed (FSK) code. Third, the FSK code is modulated into an hydraulic, FSK code. Fourth, the hydraulic, FSK code is modulated into a mechanical work, FSK code represented by the motion of reaction masses. Fifth, the mechanical work is induced within the drill string to produce essentially longitudinal, acoustic, FSK signals.

Figure 2:
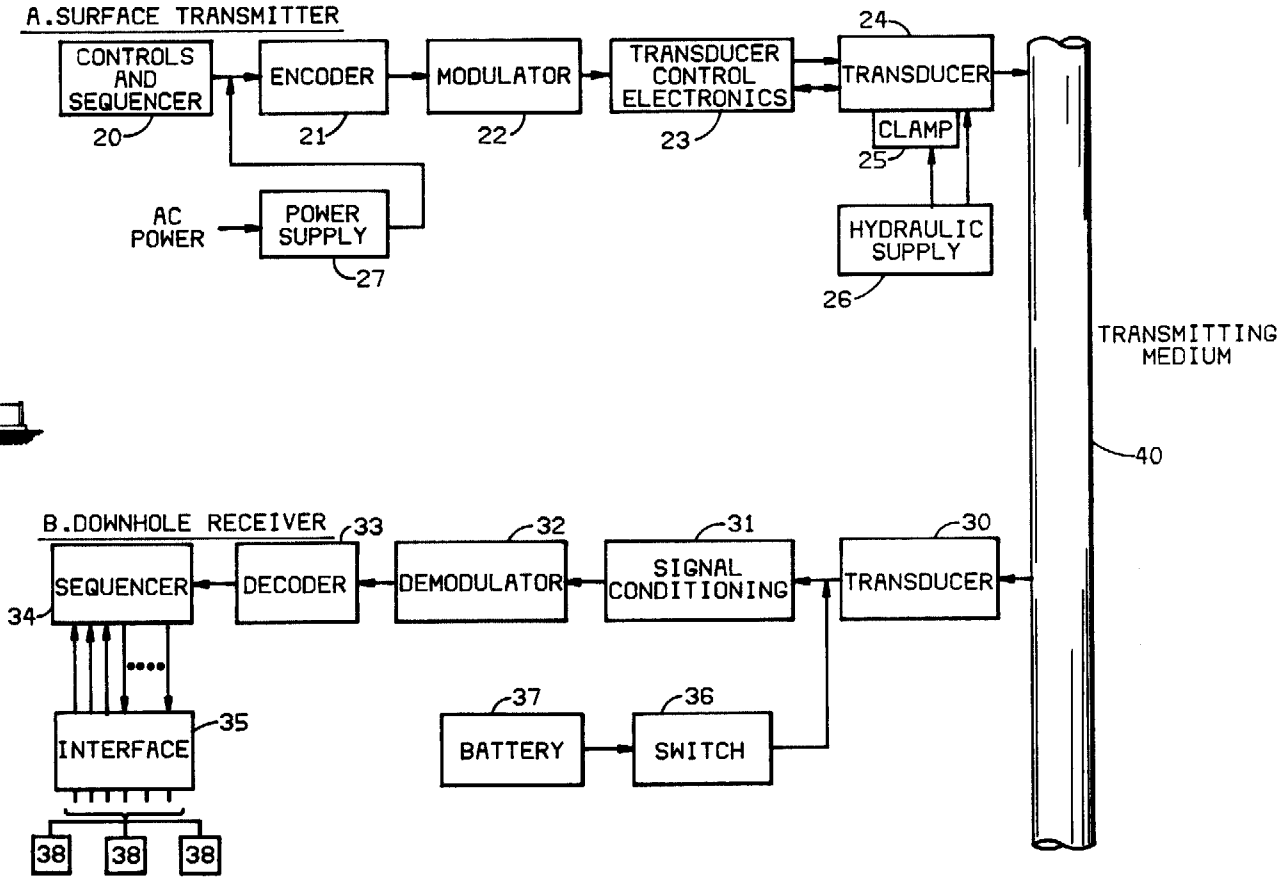
FIG. 2 is a block diagram of an acoustic telemetry system for rotary drilling.

FIG. 2 presents the details of this signalling process. It is representative only. Those skilled in the art could conceive other sequences.

The operator selects the desired downhole function and pushes the appropriate button on the control and sequencer panel 20 corresponding to the function. The job command is coded in the encoder 21 to generate a voltage shift keyed, electrical signal. That is, one voltage represents a binary one while another represents a binary zero. Power to produce the electrical signal may come from any suitable power supply 27, such as a battery or a generator. Preferably a Barker sequence code word is used to represent the job command in binary terms. Other coding is possible. The voltage shift keyed, electrical signal is modulated into a frequency shift keyed (FSK), electrical signal in the modulator 22. Preferably, a frequency of about 310±20 Hz corresponds to a binary zero and a frequency of about 370±20 Hz, to a binary one. More preferably, the signal generated will intentionally fluctuate over narrow bands to insure that the best transmissibility for a particular drill string be reached. Typically, the narrow bands are approximately 316±4 Hz and 374±3 Hz. The FSK electrical signal is modulated in the control electronics 23 and in the transducer 24 into (1) a FSK, hydraulic signal, (2) a FSK, mechanical work signal, and (3) an FSK acoustic signal within the drill string. Preferably the FSK electrical signal oscillates an electromechanical servovalve to produce a signal. The servovalve controls the flow of hydraulic fluid to each side of a piston. The piston reciprocates in its cylinder in a direction substantially parallel to the longitudinal axis of the drill string to move reaction masses in this same oscillatory motion. The reaction masses induce essentially longitudinal acoustic waves in a FSK code within the transmitting medium 40. As mentioned previously, the hydraulic fluid may come from any suitable hydraulic supply 26.

Preferably, the electrohydraulic transmitter of this invention is portable. Preferably, it is attachable and detachable from around the drill string. A hydraulic clamp 25 may be used to secure the transmitter around the transmitting medium 40. Hydraulic fluid for this clamp 25 may be supplied by any suitable hydraulic supply 26.

Preferably, the transmitting medium 40 is a drill string comprising a Kelly, drill pipe with tool joints, and drill collars. Any combination of these parts useful in rotary drilling may be used with the transmitter of this invention. Furthermore, a portion of the wellbore may be cased or cemented. To signal, typically, drilling will be stopped. At least a portion of the weight of the drill string will be supported in the slips of the drilling rig or from the rig's block. The transmitter is fastened to the drill string. It is used to acuate the desired downhole instrument package.

Transmission is possible, however, in other transmitting media. For example, the transmitter may be fastened around production tubing or around a solid metal rod. Preferably, signals may be sent in typical vertical drilling operations. When slightly or highly deviated wellbores are drilled, however, this transmitter may still be used. Telemetry is especially important when the borehole is slightly deviated.

The acoustic signal induced in transmitting medium 40 travels to the receiver 17 where a transducer 30, such as a piezoelectric accelerometer, strain gauges, or other acoustic or mechanical sensors, translates the acoustic signal into electrical impulses. A battery 37 powers the other portions of the decoding electronics. Preferably, the battery 37 is connected to a centrifugal switch 36 which operates to disconnect (to open) the circuit of the downhole receiver 17 whenever the drill string is rotating. To further conserve energy, the circuit may include a pressure switch which disconnects the circuit whenever the receiver 17 is withdrawn from the well.

The output signal of the transducer 30 is transmitted through a signal conditioning circuit where the acoustic code word (now in electrical form) is amplified. Noise is reduced or eliminated. The amplified signal passes through a demodulator 32 which converts the FSK electric signal into the voltage domain Barker sequence code word designated by the job command. The code word is compared to, or correlated with, a reference Barker sequence in the decoder 33. If the code correlates, a sequencer 34 stores the decoded message while actuation of the appropriate downhole equipment (not shown) ensues. The interface 35 connects the receiver 17 to the equipment through the appropriate circuitry of transitors, relays, SCR's, or other such devices. Multiple tasks may be done such as activation of packers, valves, measuring devices, or other devices 38, if appropriate under a single command or if multiple commands have been sequentially transmitted to the downhole receiver 17.

Figure 3:
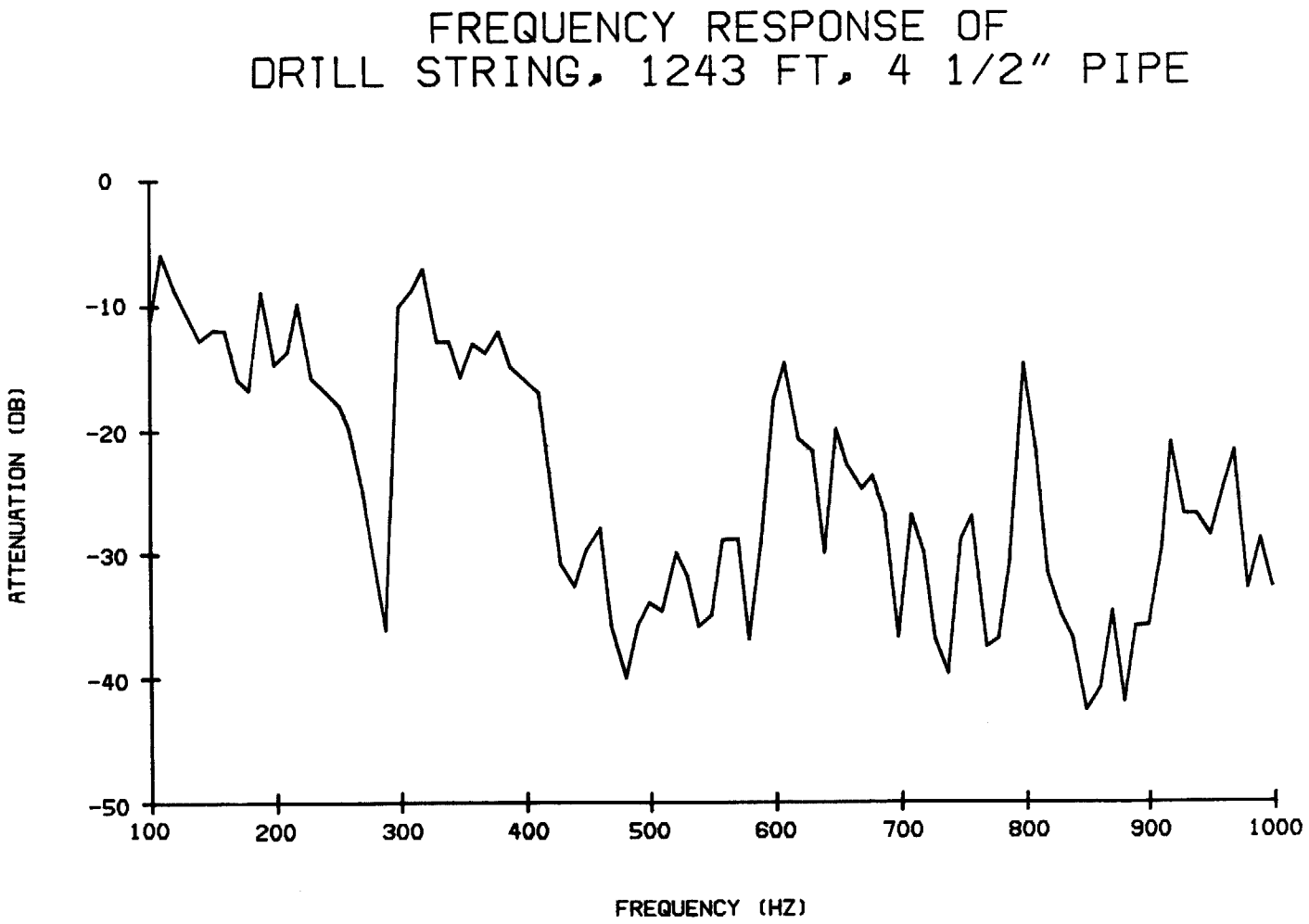
FIG. 3 is a graph showing acoustic transmissibility as a function of frequency for longitudinal, acoustic waves travelling in a typical drill string.

Particular advantages of the transmitter of this invention are that it is compact, efficient, portable, and readily attachable and detachable from around a drill string. It is designed to produce substantially pure longitudinal, acoustic waves of selected frequency which are suitable for transmission through a drill string. FIG. 3 shows a representative curve of the transmissibility for a typical drill string of longitudinal, acoustic waves as a function of frequency. The best results will be obtained if lower frequencies are used. The lower the frequency, however, the greater the energy required to generate that signal. Thus, there are power and equipment limitations to resolve. The transmitter of this invention is designed to generate longitudinal, acoustic waves between about 290 Hz and 400 Hz. This range is preferable because it combines acceptable transmissibility with desirable power requirements.

The transmitter of this invention converts frequency shift keyed, electrical impulses into mechanical work represented by both the oscillation of hydraulic pistons and of reaction masses associated with the pistons. This mechanical work is transformed subsequently into longitudinal, acoustic waves within the drill string.

Longitudinal waves travel more readily and more rapidly than transverse (torsional) waves. To produce longitudinal waves, oscillation parallel to the longitudinal axis of the drill string is induced into a portion of the drill string through gripping members. Preferably, two means for oscillating are placed substantially diametrically opposite one another around the drill string to reduce the production of transverse waves. Any number of means for oscillating may be employed, but longitudinal, acoustic waves are best induced in the drill string if an even number of means for oscillating are disposed symmetrically around the drill string. To achieve the power necessary for effective transmission to the downhole receiver, more than one means for oscillating will probably be necessary.

To determine what power is necessary, the characteristics of the receiver system and drill string must be known. Four factors must be considered: the downhole noise at the selected frequencies for transmission, the required signal to noise ratio for reception of the signal by the receiver, the attenuation losses for the path of transmission, and the desired design safety factor to ensure reliable activation and response of the downhole equipment and to minimize false responses. The sum of these four factors normally determines the necessary power output. For a 10,000-foot well, the necessary power to transmit successfully a 137 Hz signal is in the order of 24 decibels (dBg). The actual power required varies with operating conditions, well depth, drill string composition, receiver characteristics, and signal frequency.

Transmissibility is highly dependent upon frequency as discussed previously with reference to Hixson and to Barnes and Kirkwood. FIG. 3 represents the empirical results of transmission tests on a drill string. A broad passband extends from about 0 Hz to 260 Hz in close agreement with the theory. A second passband, not predicted by Barnes and Kirkwood, is found between about 290 Hz and 400 Hz. This second range is preferred for transmission of longitudinal, acoustic waves according to this invention. Although transmissibility is slightly reduced over that of the first passband, the energy in-put requirements for the transmitter are reduced to a level of practical attainment. At this second range of frequencies, the transmitter is still compact, efficient, portable, and readily attachable and detachable from the drill string.

Transmissibility appears to be a strong function of pipe joint length. FIG. 3 shows the transmissibility for common drill pipe which has a standard length of thirty (30)±two (2) feet. Corresponding to impedance mismatches, changes in pipe diameter at each drill pipe tool joint cause some reflection of signals. This strong impedance mismatch is absent in uniformly thick pipe. For a typical drill string, the impedance at tool joints is far more significant to transmissibility than absolute pipe diameter or pipe wall thickness. Pipe that has a constant diameter and wall thickness, such as production tubing or casing, will transmit acoustic signals more readily than drill pipe which has varied diameters and thicknesses in the pipe body and tool joints. Because changes in wall thickness occur at the end of each pipe joint, the transmissibility appears to be a function of pipe joint length.

Figure 5:
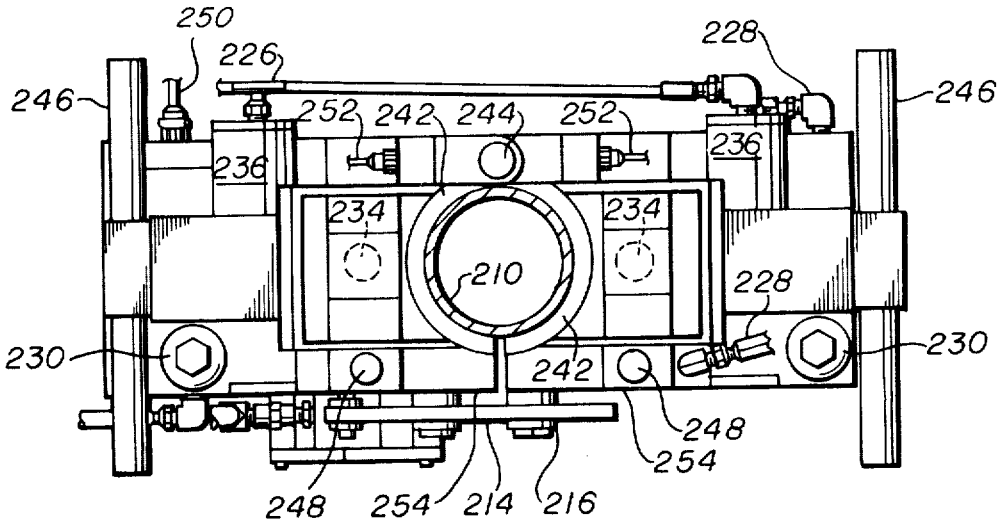
FIG. 5 is a top view of the electrohydraulic transmitter taken along line 5—5 in FIG. 4.
Figure 4:
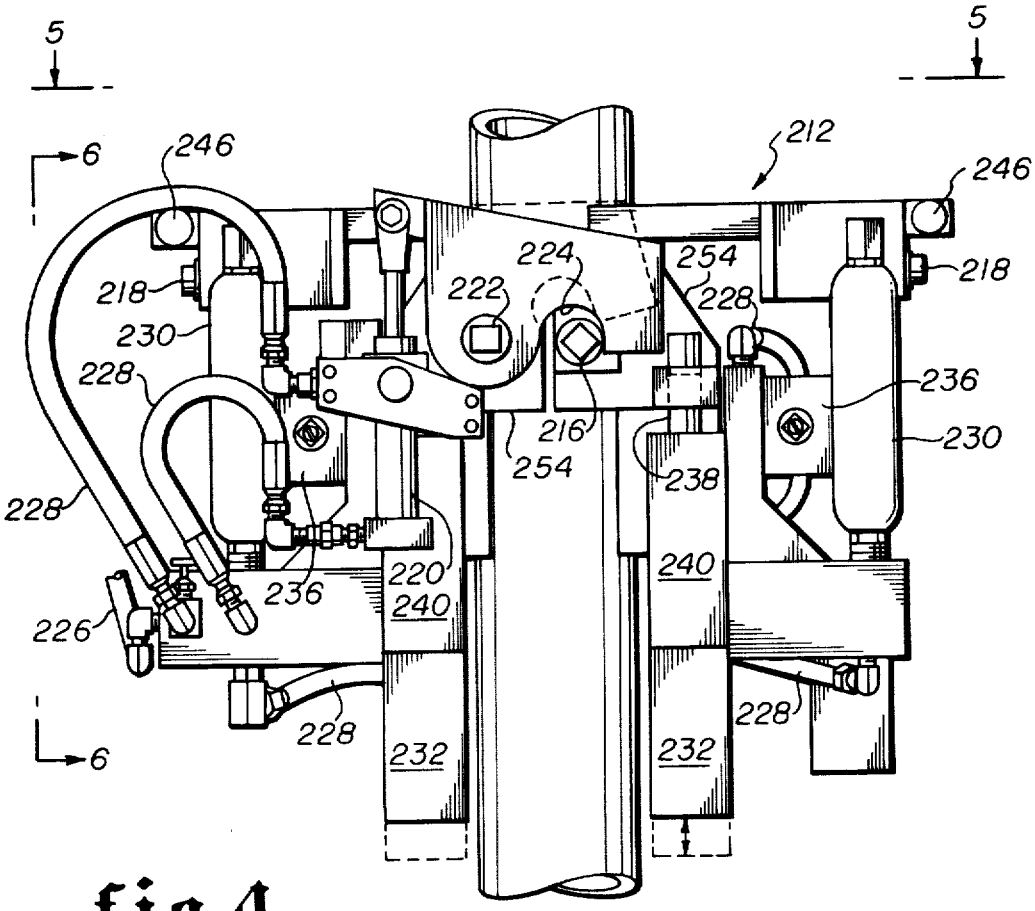
FIG. 4 is a front elevation of an electrohydraulic transmitter according to this invention.
Figure 6:
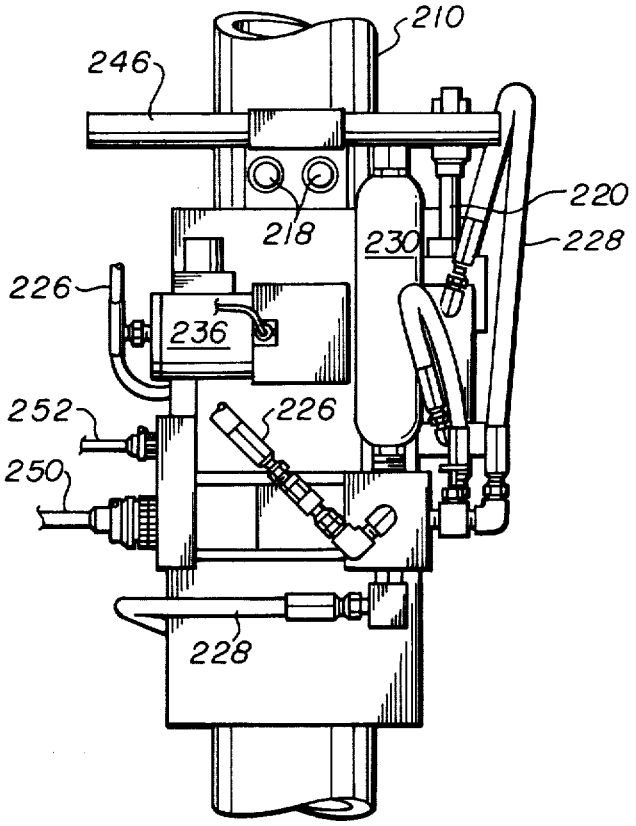
FIG. 6 is a side elevation of the electrohydraulic transmitter taken along line 6—6 of FIG. 4.

FIGS. 4–6 depict an embodiment of this invention. Because this invention is fairly complex in terms of association of parts, and because many components may have substitutes, the preferred embodiment as depicted will be described in terms of function. One skilled in the art would be able to substitute equivalent components for the particular parts described. To include these possible substitutes would do more to hinder explanation and clarity than to improve it.

The electrohydraulic transmitter 212 releasably fastens around the outer peripheral portion of the transmitting medium 210, depicted as drill pipe. A hinged housing 254 has two halves in this embodiment, each half containing one means for oscillating and one means for controlling the means for oscillating. Both are mounted on the housing 254. The housing 254 is hinged on a pivot bolt 244 on one side and is releasably connected together by a hydraulic clamp 214 on the other. The clamp 214 works by positioning a slot 224 about a lug bolt 216 by the controlled rotation of a clamp 214 around a pivot bolt 222. An hydraulic cylinder 220 drives the clamp 214. The clamp 214 securely fastens the housing 254 around the drill string 210. Attachment and detachment is controlled by control buttons 218 positioned below two handles 246 which are mounted to opposite ends of the housing 254. When the buttons are pushed, the hydraulic cylinder 220 is activated to draw the slot 224 away from the lug bolt 216. Two operators clasp the handles at either end and depress the control buttons to attach or to detach the transmitter 212 quickly. A nut and bolt assembly may be used to secure releasably the transmitter 212 to the drill string 210. The hydraulic clamp, however, is peferred because it is quicker and potentially safer. The control buttons 218 are positioned so that the operator's hands are away from all moving parts and are away from the pinch of the hinge when the transmitter is attached or detached. Because the transmitter weighs around 91 kg (200 lbs.) when constructed according to the preferred embodiment, two operators can efficiently connect it by each lifting one side. Other clamping means might reduce this speed, safety and efficiency.

Gripping members 242, depicted as a contact rim, securely grip the drill string 210 and function to connect the means for oscillating to the drill string 210. The gripping members 242 transform mechanical oscillation in a direction parallel to the longitudinal axis of the drill string 210 into longitudinal, acoustic waves within the drill string 210.

Figure 7:
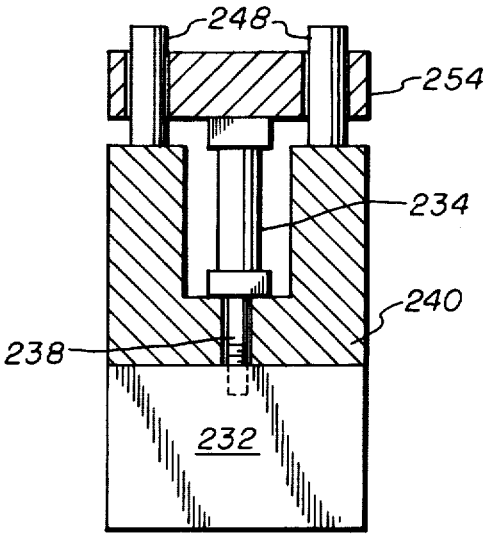
FIG. 7 is a partial, cross-sectional elevation of a reaction mass employed for production of acoustic signals by the electrohydraulic transmitter of this invention.

In the preferred embodiment of this invention as depicted in the drawings, means for oscillating are mounted to the housing 254 in contact with the gripping members 242. Hydraulic cylinders 234 are preferred. As shown in FIG. 7, pistons within the cylinders 234 are free to reciprocate in response to some means for controlling the hydraulic fluid within the cylinders. The piston's motion is induced in a rod 238 which in turn moves a reaction mass 232. A guide yoke 240 connected above the reaction mass 232 has guide rods 248 disposed in cylinders drilled in the housing 254. The guide yoke 240 and guide rods 248 insure that the reaction mass 232 oscillates substantially on a line parallel to the axis of the drill string. Associated with the oscillating reaction masses 232, the gripping members 242 transduce this physical vibration into acoustic waves within the drill string 210. The reaction masses 232 typically weigh about 32 kg (70 lbs.) to generate the desired acoustic signals.

Means for controlling the hydraulic cylinders 234 are depicted as electromechanical servovalves 236. A servovalve 236 is operably associated with each hydraulic cylinder 234 to control the flow of hydraulic fluid to and from the sides of the piston. The hydraulic fluid forces the piston to move both upwardly and downwardly. Line 226 carries hydraulic fluid from a supply (not shown) to the accumulator 230, which serves as a reservoir and as a damping mechanism. Lines 228 carry the hydraulic fluid to and from the accumulator 230 to and from the hydraulic cylinders 234 through the servovalves 236.

The modulated code word produced in the control electronics (not shown) is delivered to the servovalve 236 along the electrical cable 250. The servovalve 236 converts the electrical frequency shift keyed signal into mechanical oscillations which are amplified by the hydraulic cylinder apparatus to induce longitudinal, acoustic waves within the drill string 210. Power to operate both the servovalves 236 and the control buttons 218 for the hydraulic clamp 214 is supplied by electrical cable 252.

The details of one embodiment of this invention have been described. The apparatus to produce low frequency, coded, acoustic signals in the drill string has been illustrated in a detailed discussion of the mechanical features. Those skilled in the art will be capable of substituting parts while maintaining the features which distinguish this apparatus from prior attempts at producing a commercially suitable acoustic transmitter. The description provided is not meant to restrict the invention except as is necessary by an interpretation of the prior art and by the spirit of the appended claims.

We claim:

1. A method for transmitting information along the length of a drill pipe comprising the steps of:

(a) generating a first group of essentially longitudinal, acoustic waves within said drill pipe at a first frequency from about 290–330 Hertz or about 350–390 Hertz with the oscillating motion of reaction masses symmetrically disposed around said drill pipe, said motion being in a direction substantially parallel to the longitudinal axis of said drill pipe;

(b) generating a second group of essentially longitudinal, acoustic waves within said drill pipe at a second frequency from about 290–330 Hertz or about 350–390 Hertz with the oscillating motion of said reaction masses, the order of the frequency of said first and second group of acoustic waves representing said information; and (c) receiving said acoustic waves at another point along the length of said drill pipe and detecting said information.

2. The method of claim 1 wherein said frequency are about 312–320 and about 371–377 Hertz.

* * * * *